US008215148B2

(12) United States Patent
Fujimura et al.

(10) Patent No.: US 8,215,148 B2
(45) Date of Patent: Jul. 10, 2012

(54) SHEAR PUNCHING DIE ASSEMBLIES

(75) Inventors: Shirou Fujimura, Aichi-ken (JP); Kouhei Ushida, Toyota (JP); Takuma Watanabe, Aichi-ken (JP)

(73) Assignee: Toyota Boshoku Kabushiki Kaisha, Aichi (JP)

( * ) Notice: Subject to any disclaimer, the term of this patent is extended or adjusted under 35 U.S.C. 154(b) by 651 days.

(21) Appl. No.: 12/514,116

(22) PCT Filed: Nov. 14, 2007

(86) PCT No.: PCT/JP2007/072492

§ 371 (c)(1),
(2), (4) Date: May 8, 2009

(87) PCT Pub. No.: WO2008/059989

PCT Pub. Date: May 22, 2008

(65) Prior Publication Data

US 2009/0301161 A1 Dec. 10, 2009

(30) Foreign Application Priority Data

Nov. 15, 2006 (JP) ..... 2006-309092
Nov. 6, 2007 (JP) ..... 2007-288436

(51) Int. Cl.
*B21D 45/06* (2006.01)
*B26D 7/06* (2006.01)

(52) U.S. Cl. ..... 72/344; 72/328; 72/345; 83/128

(58) Field of Classification Search ..... 72/328, 72/344, 345, 427; 83/123, 124, 125, 126, 83/127, 128

See application file for complete search history.

(56) References Cited

U.S. PATENT DOCUMENTS 3,889,563 A * 6/1975 Westermann ..... 83/124
4,131,042 A * 12/1978 Rich et al. ..... 83/100
6,305,209 B1 10/2001 Suzuki et al.

FOREIGN PATENT DOCUMENTS

DE 2831775 A1 1/1980
EP 1043093 A 10/2000

(Continued)

OTHER PUBLICATIONS

Chinese Office Action, 200780046552.4, Jul. 12, 2010.*

(Continued)

*Primary Examiner* — Edward Tolan
(74) *Attorney, Agent, or Firm* — Greenblum & Bernstein P.L.C.

(57) ABSTRACT

A shear punching die assembly having first and second die units in which a material is punched to form a work while the material is clamped between the first and second die units is taught that preferably include a main punch contained in the first die unit and having a cross-sectional shape corresponding to a shape of the work, an ejector contained in the second die unit and positioned axially opposite to the main punch, an ejector biasing member normally biasing the ejector toward the main punch, an ejector retaining device that is capable of acting on the ejector when the first and second die units are in a closed condition, thereby retaining the ejector in a predetermined position, and an ejector releasing device that is capable of acting on the ejector retaining device when the first and second die units are opened over a desired distance, thereby releasing the ejector.

9 Claims, 12 Drawing Sheets

FOREIGN PATENT DOCUMENTS

| | | | | |
|---|---|---|---|---|
| JP | 47-36271 | | | 11/1972 |
| JP | 3-057524 | A | | 3/1991 |
| JP | 4-28425 | | | 1/1992 |
| JP | 6-031695 | A | | 2/1994 |
| JP | 9-276953 | | * | 10/1997 |
| JP | 2000-280033 | | | 10/2000 |
| JP | 2001-121220 | | | 5/2001 |
| JP | 2002-35857 | | | 2/2002 |
| JP | 2002-336917 | A | | 11/2002 |
| SU | 1754285 | | * | 8/1992 |

OTHER PUBLICATIONS

English language Abstract of JP 3-057524 A, Mar. 12, 1991.
English language Abstract of JP 2002-336917 A, Nov. 26, 2002.
English language Abstract of JP 6-031695 A, Feb. 8, 1994.
Japan Office action, dated May 1, 2012 along with an english translation thereof.

* cited by examiner

SHEAR PUNCHING DIE ASSEMBLIES

TECHNICAL FIELD

The present invention relates to shear punching die assemblies. More particularly, the present invention relates to shear punching die assemblies in which a material is pressed or punched to form a work while the material is clamped between upper and lower die units of the shear punching die assembly.

BACKGROUND ART

A known shear punching die assembly includes a lower die unit that has a main punch and a stripper disposed around the main punch, and an upper die unit that has an ejector positioned axially opposite to the main punch and a die disposed around the ejector. In the known art, a material (a sheet material) is transferred and placed between upper and lower die units of the shear punching die assembly. Thereafter, the upper and lower die units are closed (i.e., a die closing operation is performed), so that the main punch of the lower die unit engages the die of the upper die unit. As a result, the material is punched out by the main punch, so that a formed article or work is formed. At this time, the ejector is moved to a retracted position with the work, so that the work can be retained in the die. Subsequently, the upper and lower die units are opened (i.e., a die opening operation is performed). Thereafter, a hydraulic removing mechanism (a hydraulic cylinder) connected to the ejector is actuated so as to push the ejector. As a result, the work retained in the die is ejected or removed from the die. Thus, a punching operation (a work manufacturing operation) is completed. Further, such a known shear punching die assembly is taught, for example, by Japanese Laid-open Patent Publication Number 6-31695.

However, in the known shear punching die assembly, it is not possible to rapidly eject the work from the die of the upper die unit, because the hydraulic removing mechanism cannot generally be moved at high speeds. That is, a work removing operation cannot be speeded up beyond a certain level. Therefore, even if a punching operation of the material is speeded up, a manufacturing speed of the work cannot substantially be increased. This may lead to a speed up limitation of a manufacturing speed of the work.

In another shear punching die assemblies, a motor driven removing mechanism or a spring driven removing mechanism is used in place of the hydraulic removing mechanism. Because the motor driven removing mechanism or the spring driven removing mechanism can generally be moved at high speeds than the hydraulic removing mechanism, the work removing operation can be speeded up. However, these shear punching die assemblies have some drawbacks. For example, in the spring driven removing mechanism, the ejector is normally biased toward the main punch. Therefore, the work can be thrust back from the die of the upper die unit toward a processed material before the upper and lower die units are sufficiently opened. As a result, the work may be pushed toward the processed material at the start of the die opening operation. The pushed work may possibly reengage a punched hole of the processed material. Therefore, extra time is required for removing the work from the processed material. Thus, these shear punching die assemblies still admit of improvement.

DISCLOSURE OF INVENTION

Thus, there is a need in the art for an improved shear punching die assembly.

In one embodiment of the present invention, shear punching die assembly having first and second die units in which a material is punched to form a work while the material is clamped between the first and second die units may include a main punch contained in the first die unit and having a cross-sectional shape corresponding to a shape of the work, an ejector contained in the second die unit and positioned axially opposite to the main punch, an ejector biasing member normally biasing the ejector toward the main punch, an ejector retaining device that is capable of acting on the ejector when the first and second die units are in a closed condition, thereby retaining the ejector in a predetermined position, and an ejector releasing device that is capable of acting on the ejector retaining device when the first and second die units are opened over a desired distance, thereby releasing the ejector.

According to the present embodiment, the work can be rapidly ejected from the second die unit because a hydraulic removing mechanism is not used. In addition, the work can be automatically removed from the second die unit when the first and second die units are opened. Therefore, a manufacturing speed of the work can be easily speeded up by simply speeding up a punching operation of the material.

In addition, the work is reliably retained on the second die unit until the first and second die units are sufficiently opened. Therefore, the work can be effectively prevented from interfering with a processed material when the first and second die units are opened. In particular, the work can be effectively prevented from reengaging a punched hole of the processed material. Therefore, an extra time is not required for removing the work from the processed material. This may contribute to further speeding up of the manufacturing speed of the work.

In another embodiment of the invention, the ejector retaining device may include a pressing body and a retainer member. The retainer member is arranged and constructed to engage the pressing body and press the pressing body toward an outer circumferential surface of the ejector when the first and second die units are in the closed condition. The retainer member is arranged and constructed to be disengaged from the pressing body when the first and second die units are moved to an opened condition, so as to permit the pressing body to move away from the outer circumferential surface of the ejector. The ejector releasing device is composed of the ejector biasing member. The ejector biasing member is arranged and constructed to be capable of moving the ejector when the first and second die units are moved to the opened condition, thereby moving the pressing body away from the outer circumferential surface of the ejector.

In a further embodiment of the invention, the ejector may include an engagement recess that are capable of engaging the pressing body. The retainer member is arranged and constructed to be capable of moving toward and away from the pressing body when the first and second die units are closed and opened.

In a further embodiment of the invention, the ejector retaining device may include a pressing body and an pressing body biasing member. The pressing body biasing member is arranged and constructed to normally bias the pressing body toward an outer circumferential surface of the ejector. The ejector releasing device comprises a first contacting member formed in an arm that is attached to the first die unit, and a second contacting member formed in the pressing body. The first contacting member is arranged and constructed to engage the second contacting member when the first and second die units are moved to the opened condition, thereby moving the pressing body away from the outer circumferential surface of the ejector against a biasing force of the pressing body biasing member.

In a further embodiment of the invention, the pressing body and the ejector may respectively include an engagement projection and an engagement recess that are capable of engaging each other. The first and second contacting members may respectively include a protrusion formed in the arm and a rod attached to the pressing body, In a still further embodiment of the invention, the arm may have a guide slot that is arranged and constructed such that the rod can move therealong when the upper and lower die units are relatively moved. The protrusion may be projected into the guide slot such that a width of the guide slot can be reduced.

Other objects, features, and advantages, of the present invention will be readily understood after reading the following detailed description together with the accompanying drawings and the claims.

BEST MODE FOR CARRYING OUT THE INVENTION

Detailed representative embodiments of the present invention will now be described with reference to the drawings.

First Detailed Representative Embodiment

First, a first embodiment of the present invention will be described with reference to FIGS. 1 to 7.

A shear punching die assembly is intended to press or punch a strip-shaped metal sheet material M in order to form a molded material or work W. The work W may be utilized as, for example, a construction element of a seat reclining device of a vehicle. Further, the shear punching die assembly is constructed such that the sheet material M is continuously fed vertically to a plane in FIGS. 1 and 3-7.

Figure 1:
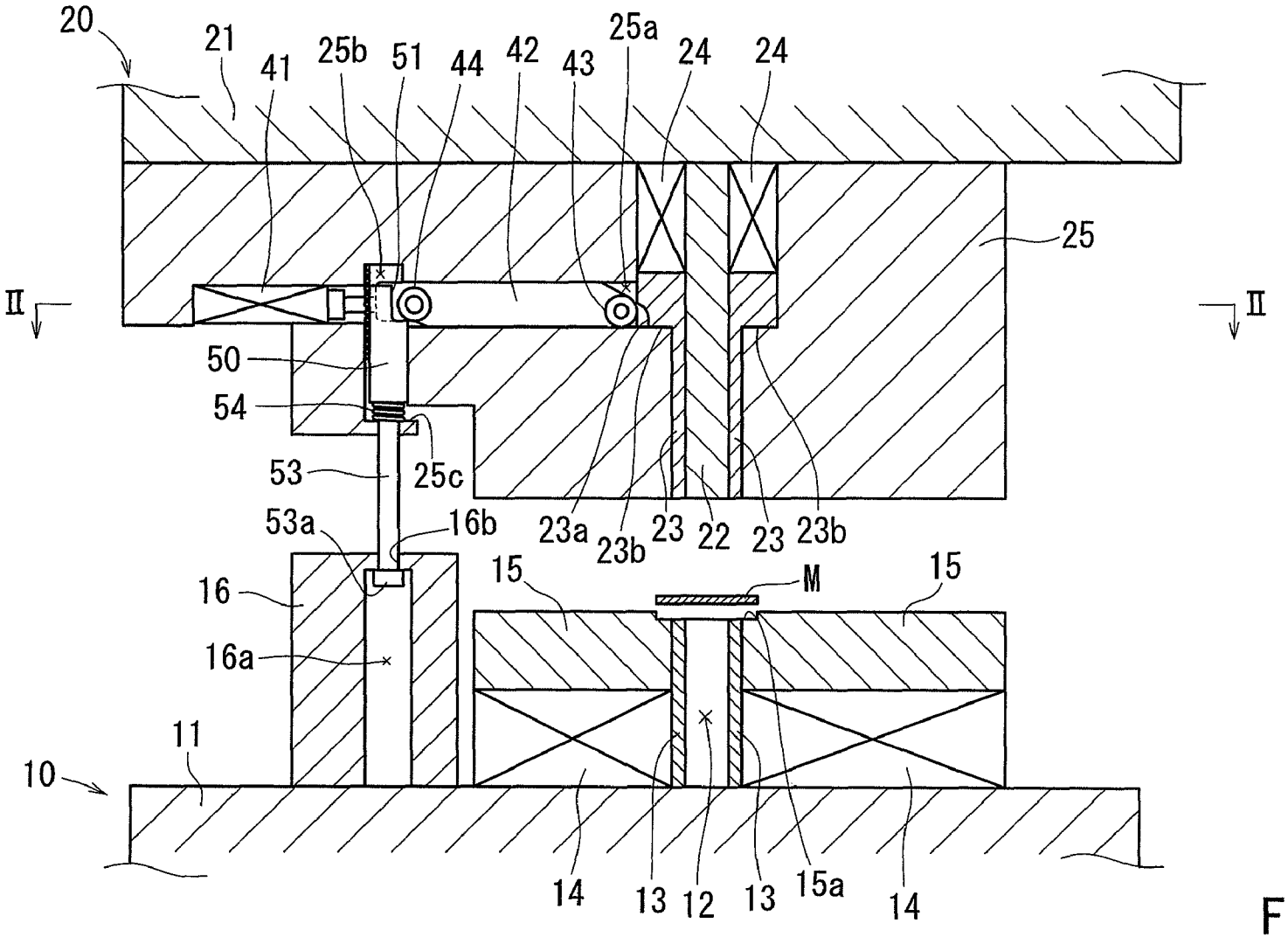
FIG. 1 is a vertical cross-sectional view of a shear punching die assembly according to a first representative embodiment of the present invention, illustrating a condition in which upper and lower die units are opened (an upper dead center of the upper die unit)
Figure 2:
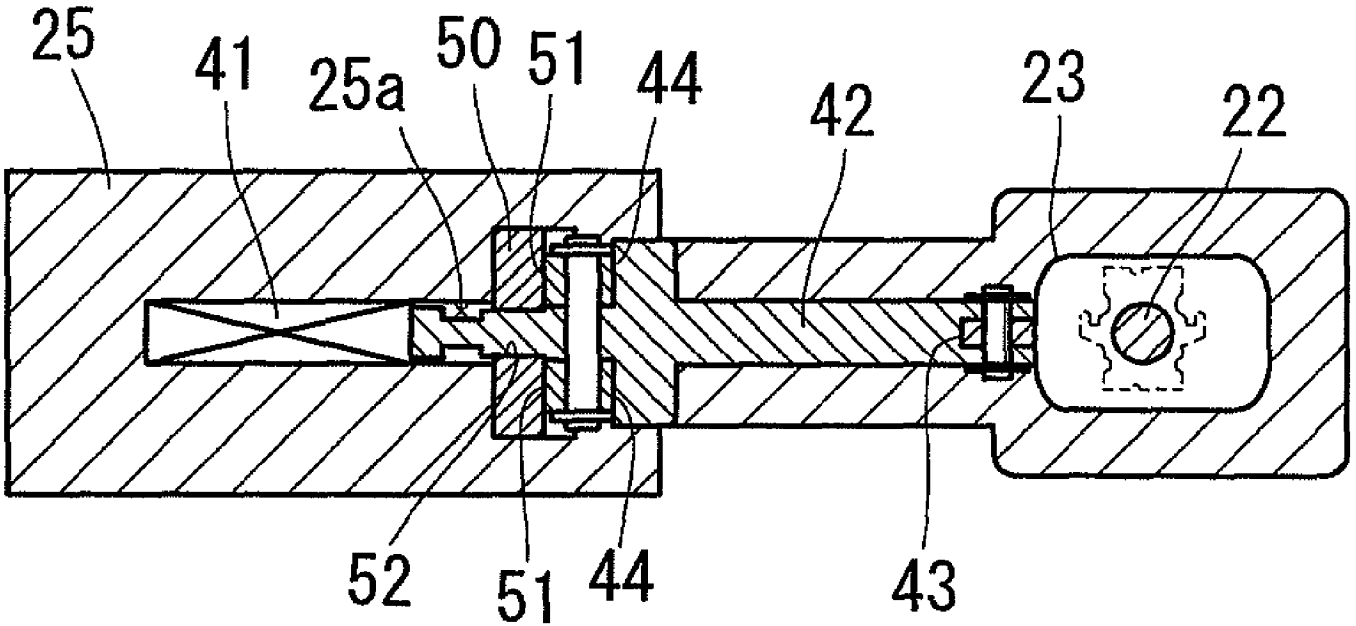
FIG. 2 is a cross-sectional view taken along line II-II in FIG. 1.
Figure 3:
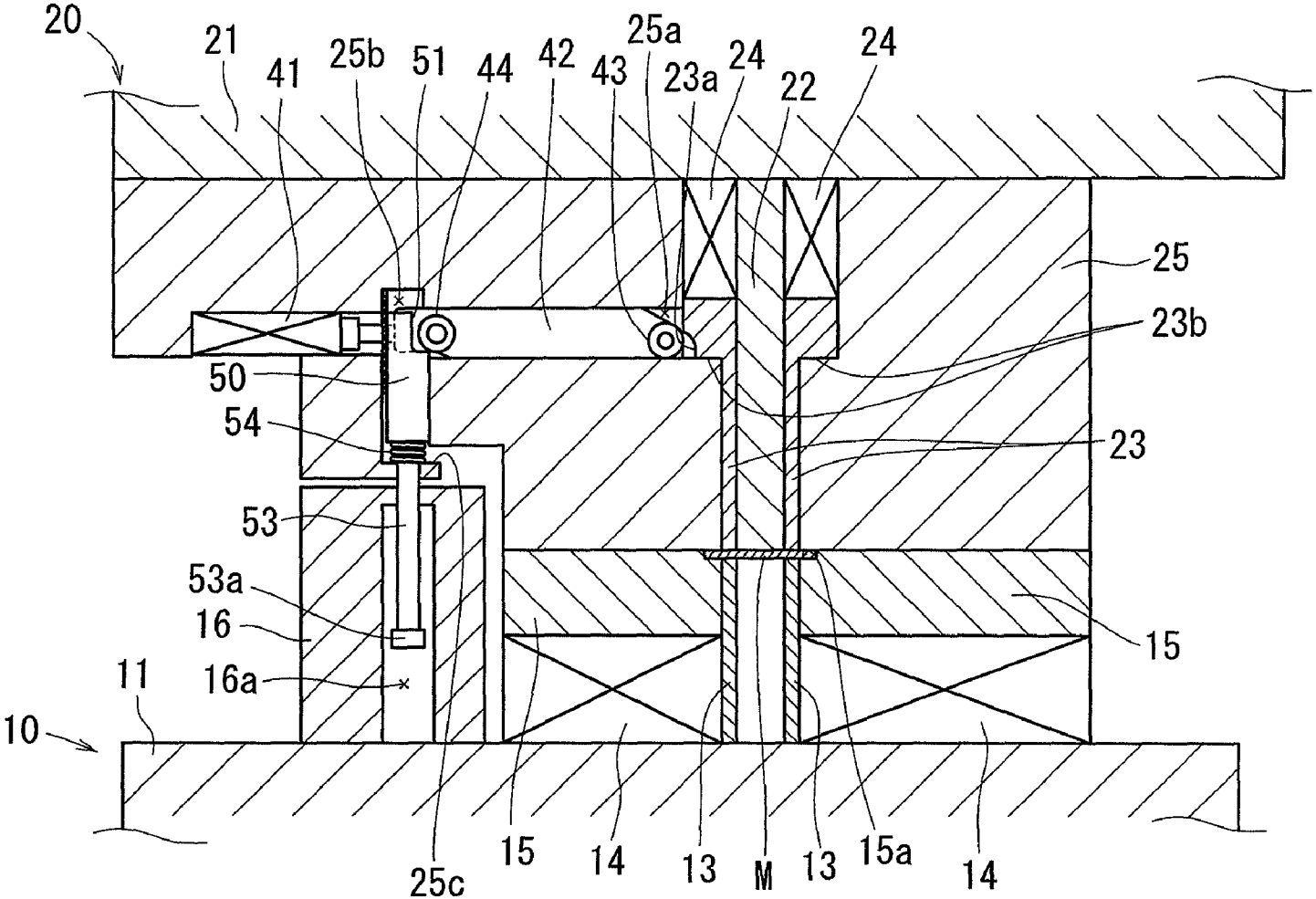
FIG. 3 is a vertical cross-sectional view of the shear punching die assembly, illustrating a condition in which a material is clamped between the upper and lower die units.

As shown in, for example, FIGS. 1 and 2, the shear punching die assembly may include a lower or first die unit (a stationary die unit) 10 that is associated with a lower or first base 11 and an upper or second die unit (a movable die unit) 20 that is associated with an upper or second base 21. Further, the second base 21 is connected to a drive means (not shown), so that the upper die unit 20 can vertically move toward and away from the lower die unit 10.

As shown in FIG. 1, the lower die unit 10 is essentially composed of a lower pressing member or punch (a main punch) 13 and a stripper 15. The lower punch 13 is fixedly attached to the lower base 11 and having a cross-sectional shape corresponding to the work W to be formed. Also, the lower punch 13 has a vertical punching hole 12 that is formed therein. The stripper 15 is movably disposed around the lower punch 13. In addition, the stripper 15 has a bore having a cross-sectional shape corresponding to the cross-sectional shape of the lower punch 13. That is, the stripper 15 is closely adjacent to the lower punch 13. Also, the stripper 15 is movably attached to the lower base 11 via a compression spring or a gas spring (a first elastic member) 14. Therefore, the stripper 15 is capable of vertically moving along the lower punch 13 while closely contacting the same. Further, the gas spring 14 is arranged so as to normally bias the stripper 15 upwardly. In addition, the stripper 15 has a recessed portion 15*a* that can receive the sheet material M therein. As will be appreciated, the recessed portion 15*a* has a bottom surface that is shaped to be coplanar with an upper end surface of the lower punch 13 when the stripper 15 is in a normal position (an uppermost position).

As shown in FIG. 1, the lower die unit 10 further includes a guide member 16. The guide member 16 may function to control or restrict an upward motion of a vertical rod 53 of a backup block or retainer member 50, which will be described hereinafter. The guide member 16 is juxtaposed to the stripper 15 and is attached to the lower base 11 so as to extend toward the upper die unit 20. The guide member 16 has an inverted U-shape in cross section, so as to have an inner bore 16*a* therein. Further, the guide member 16 has a vertical guide slot 16*b* that is formed in an upper wall thereof.

As shown in FIG. 1, the upper die unit 20 is essentially composed of an upper pressing member or punch (a subsidiary punch) 22, an ejector 23 and a die 25. The upper punch 22 is fixedly attached to the upper base 21 and having a cross-sectional shape corresponding to the punching hole 12 of the lower punch 13. The ejector 23 is movably disposed around the upper punch 22 and is positioned axially opposite to the lower punch 13. Also, the ejector 23 has a cross-sectional shape corresponding to the work W. In other words, the ejector 23 has the same cross-sectional shape as the lower punch 13. The die 25 is fixedly attached to the upper base 21. The die 25 is positioned around the ejector 23 in such a way that the ejector 23 is permitted to move therealong. In addition, the die 25 has a bore having a cross-sectional shape corresponding to the cross-sectional shape of the ejector 23. That is, the die 25 is closely adjacent to the ejector 23.

The ejector 23 is movably attached to the upper base 21 via a compression spring or a gas spring (a second elastic member) 24. Therefore, the ejector 23 is capable of vertically moving along the upper punch 22 and the die 25 while closely contacting the same. Further, the gas spring 24 is arranged so as to normally bias the ejector 23 downwardly.

As shown in FIG. 1, the ejector 23 has an upper shouldered portion 23*b*. The upper shouldered portion 23*b* of the ejector 23 has an engagement recess or notch 23*a* that is formed in an outer circumferential surface thereof. Conversely, the die 25 has a lateral hollow portion 25*a* that is laterally formed therein. The lateral hollow portion 25*a* is arranged so as to be communicated with the notch 23*a* of the ejector 23. Also, the die 25 has a vertical hollow portion 25*b* that is communicated with the lateral hollow portion 25*a*. The vertical hollow portion 25*b* is formed in the die 25 so as to be perpendicular to the lateral hollow portion 25*a*.

As shown in FIG. 1, an ejector block or ejector locking member or (a pressing body) 42 is laterally slidably received in the lateral hollow portion 25*a*, so as to move toward and away from the notch 23*a* of the ejector 23. A front or inner end (a right end in the drawings) of the ejector locking member 42 is provided with a front roller 43. Conversely, a rear or outer end (a left end in the drawings) of the ejector locking member 42 is provided with a pair of rear rollers 44 (FIG. 2). The front roller 43 is shaped so as to be capable of selectively engaging the notch 23*a*. Further, as will be apparent from FIG. 1, the front roller 43 is arranged so as to be not aligned with the notch 23*a* (i.e., so as to be slightly displaced upwardly from the notch 23*a*) when the ejector 23 is in a normal position. In addition, the outer end of the ejector locking member 42 is provided with a compression spring or a gas spring (a third elastic member) 41 that is received in the lateral hollow portion 25*a* of the die 25. The compression spring 41 of the ejector locking member 42 is arranged so as to normally bias the ejector locking member 42 rightwardly, i.e., toward the notch 23*a* of the ejector 23. Further, the compression spring 41 may preferably has a spring force smaller than the compression spring 24.

Further, as shown in FIG. 1, a retainer member 50 is vertically slidably received in the vertical hollow portion 25*b* of the die 25. The retainer member 50 has a lateral recess 51 that is formed in an upper end of thereof. The recess 51 is shaped so as to be capable of selectively receiving the rear rollers 44 therein. Also, the retainer member 50 has a vertical recess 52 that is formed in an upper end of thereof (FIG. 2). The vertical recess 52 slidably engages the outer end of the ejector locking member 42.

The retainer member 50 is integrally provided with a downwardly extended vertical rod 53. The vertical rod 53 has a head or enlarged portion 53*a* that is formed in a lower end thereof. The vertical rod 53 is introduced into the inner bore 16*a* of the guide member 16 through the guide slot 16*b*, so that the head portion 53*a* can move upwardly and downwardly in the inner bore 16*a*. Further, the head portion 53*a* is positioned so as to contact or engage the upper wall of the guide member 16 when the upper die unit 20 is lifted up to a desired position from a closed position (i.e., when the upper and lower die units 10 and 20 open from a closed condition shown in FIG. 4 and reach a half opened condition shown in FIG. 5), thereby preventing the retainer member 50 from further moving upwardly.

Also, the vertical rod 53 is provided with a compression spring 54 that is positioned between the retainer member 50 and a spring seat 25*c* formed in the die 25. The compression spring 54 is arranged so as to normally bias the retainer member 50 upwardly Further, in this embodiment, the ejector locking member 42 and the retainer member 50 will also be referred to as an ejector retaining device that can retain the ejector 23 in a predetermined position (an upper retracted position). Also, the compression spring 24 will be referred to as an ejector releasing device that can release the ejector 23 retained in the predetermined position.

Representative methods for manufacturing the work W from the sheet material M using this shear punching die assembly will now be described.

First, as shown in FIG. 1, the drive means is actuated so that the upper die unit 20 is lifted up to an uppermost position or opened position (i.e., the upper and lower die units 10 and 20 are fully opened to an opened condition). In this condition, the sheet material M is fed into a space between the upper and lower die units 10 and 20. At this time, the retainer member 50 is positioned at a lowermost position in the vertical hollow portion 25*b* of the die 25. Also, the front roller 43 is not aligned with the notch 23*a*, so as to contact the outer circumferential surface of the upper shouldered portion 23*b* of the ejector 23. Therefore, the ejector locking member 42 is leftwardly shifted, so that the rear rollers 44 engage the recess 51 of the retainer member 50.

Thereafter, the drive means is actuated so that the upper die unit 20 is moved downwardly toward the lower die unit 10 (i.e., a die closing operation or punching operation is started). When the upper and lower die units 10 and 20 reach a condition shown in FIG. 3, the sheet material M is clamped between the upper and lower die units 10 and 20 (between the ejector 23 and the lower punch 13 and between the die 25 and the stripper 15) while it is received in the recessed portion 15*a* of the stripper 15. At this time, the vertical rod 53 of the retainer member 50 enters into the inner bore 16*a* of the guide member 16 while the retainer member 50 is positioned at the lowermost position. Therefore, the ejector locking member 42 is still leftwardly shifted.

Figure 4:
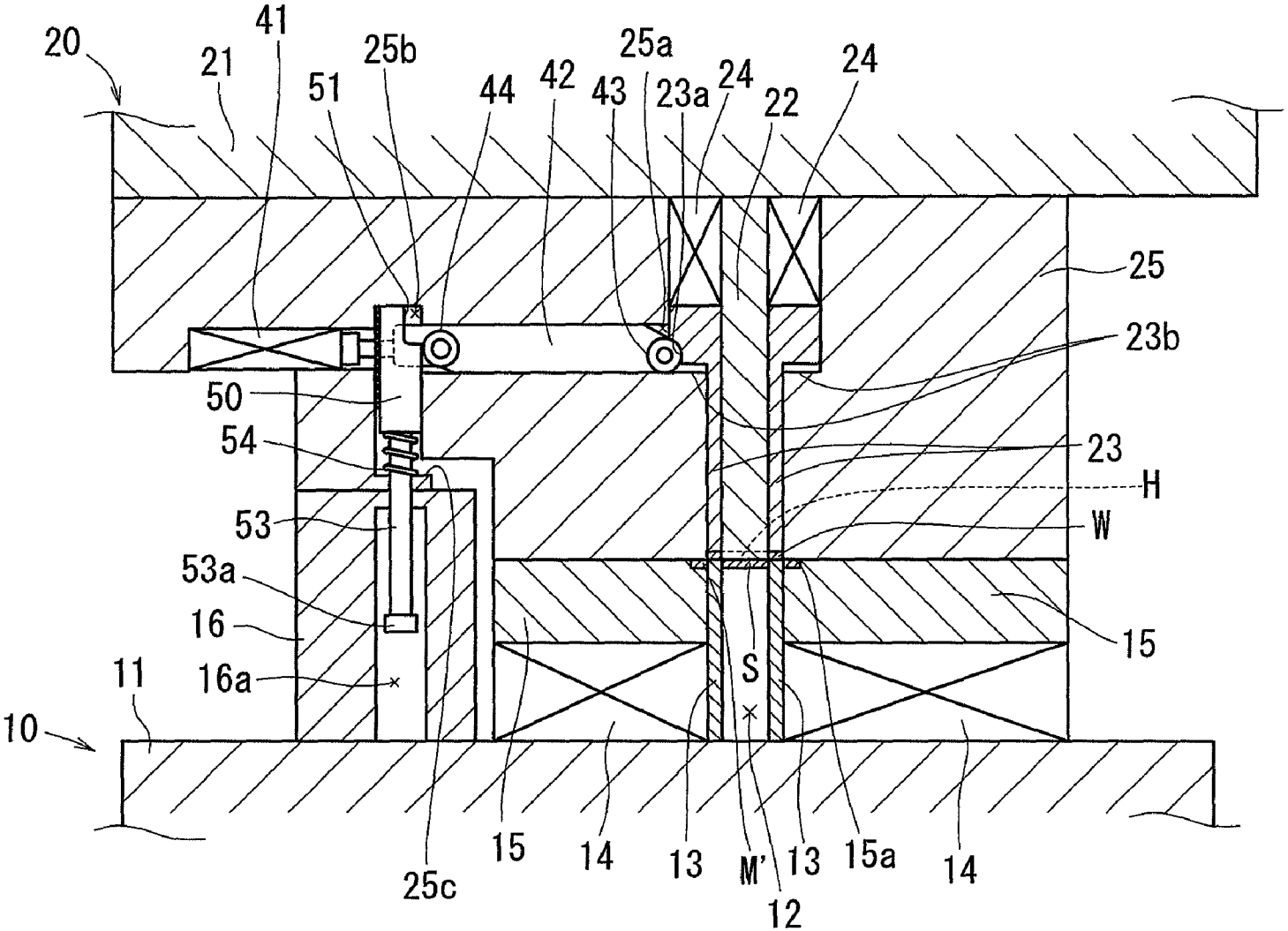
FIG. 4 is a vertical cross-sectional view of the shear punching die assembly, illustrating a condition in which upper and lower die units are closed (a lower dead center of the upper die unit)

Subsequently, when the upper die unit 20 is further moved toward the lower die unit 10 and reaches a closed position shown in FIG. 4 (i.e., when the die closing operation is completed, so that the upper and lower die units 10 and 20 are completely closed to a closed condition), the upper punch 22 and the die 25 of the upper die unit 20 respectively engage the lower punch 13 of the lower die unit 10, so as to form the work W having a central opening H. At the same time, a waste or processed sheet material M' and a waste piece S are produced. Thus, the punching operation is completed.

At this time, the ejector 23 of the upper die unit 20 is moved upwardly by the work W against a spring force of the gas spring 24, so as to be shifted to the upper retracted position from the normal position. As a result, the work W may preferably be clamped between the ejector 23 and the lower punch 13. Similarly, the stripper 15 of the lower die unit 10 is moved downwardly against the spring force of the gas spring 14, so as to be shifted to a lower retracted position thereof. As a result, the processed sheet material M' may preferably be clamped between the die 25 and the stripper 15. Further, the waste piece S corresponding to the central opening H of the work W may fall down into the punching hole 12 of the lower punch 13.

When the ejector 23 is shifted to the upper retracted position, the front roller 43 of the ejector locking member 42 is aligned with the notch 23*a*. Consequently, the ejector locking member 42 is rightwardly moved by the spring force of the compression spring 41, so that the front roller 43 engages the notch 23*a* of the ejector 23.

Upon rightward movement of the ejector locking member 42, the rear rollers 44 of the ejector locking member 42 are disengaged from the recess 51 of the retainer member 50. As a result, the retainer member 50 is moved upwardly toward an uppermost position thereof by a spring force of the compression spring 54, so as to contact the rollers 44 (FIG. 4). Therefore, the front roller 43 can be effectively prevented from being disengaged from the notch 23*a* of the ejector 23, thereby locking the ejector 23. Thus, the ejector locking member 42 may preferably be retained in an ejector retaining position, so that the ejector 23 can be reliably maintained at the retracted position (FIG. 4).

After the punching operation is completed, the drive means is actuated so that the upper die unit 20 is lifted up toward the opened position. Thus, a die opening operation or work removing operation is started. At this time, the vertical rod 53 of the retainer member 50 is drawn from the inner bore 16*a* of the guide member 16 while the retainer member 50 is positioned at the uppermost position (i.e., while the front roller 43 of the ejector locking member 42 engages the notch 23*a* of the ejector 23.) As a result, the upper die unit 20 is lifted up while the ejector 23 is maintained at the upper retracted position. That is, the upper die unit 20 is moved upwardly while the work W is not applied with the spring force of the gas spring 24 via the ejector 23. Therefore, the upper die unit 20 is lifted up while the work W is reliably retained between the upper punch 22 and the die 25 by a frictional force.

Figure 5:
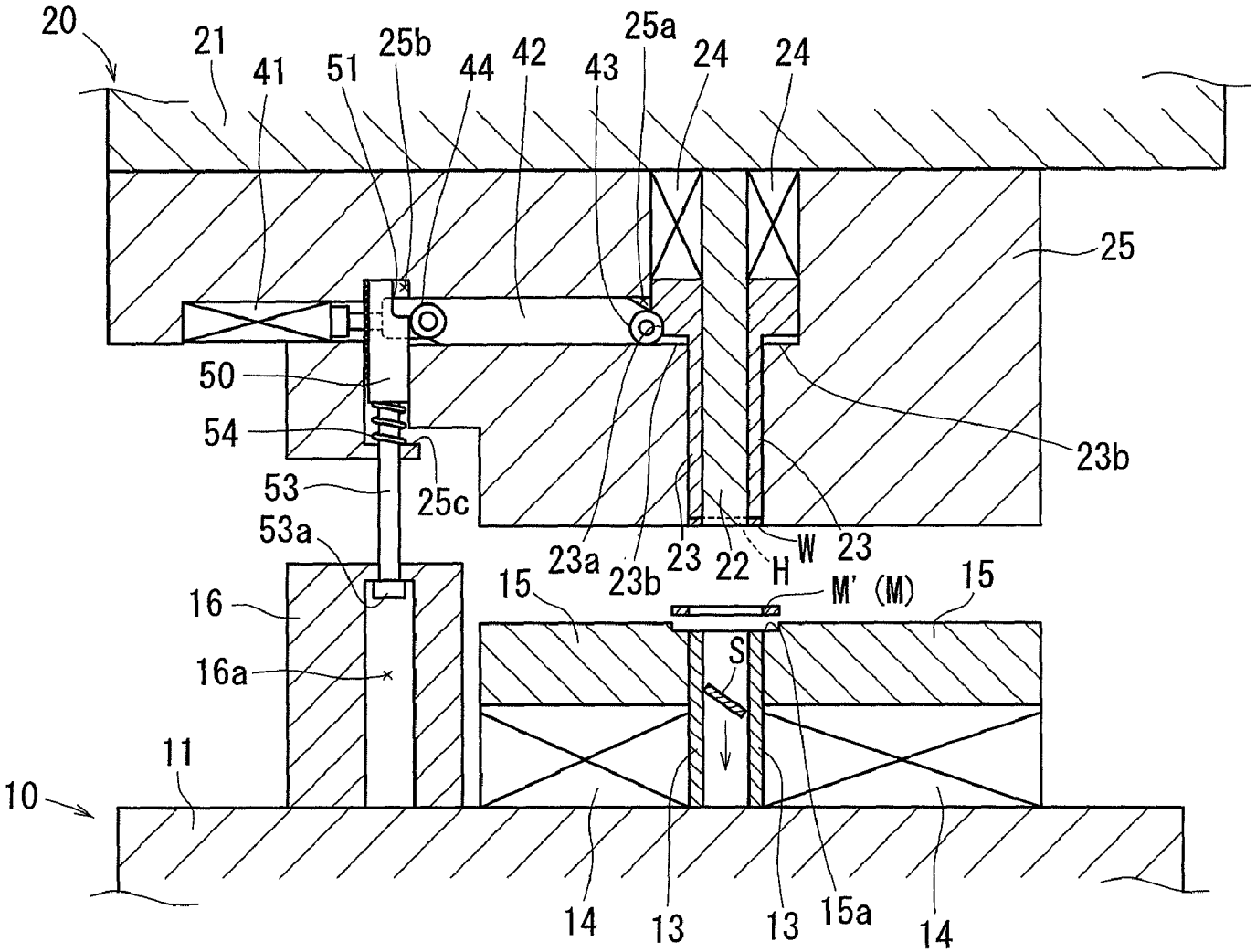
FIG. 5 is a vertical cross-sectional view of the shear punching die assembly, illustrating a condition in which upper and lower die units are half opened from the condition shown in FIG. 4.

Thereafter, when the upper die unit 20 reaches the desired position shown in FIG. 5 (i.e., when the upper and lower die units 10 and 20 are opened over a desired distance), the head portion 53*a* of the vertical rod 53 contacts the upper wall of the guide member 16, so that the retainer member 50 can be prevented from further moving upwardly.

Figure 6:
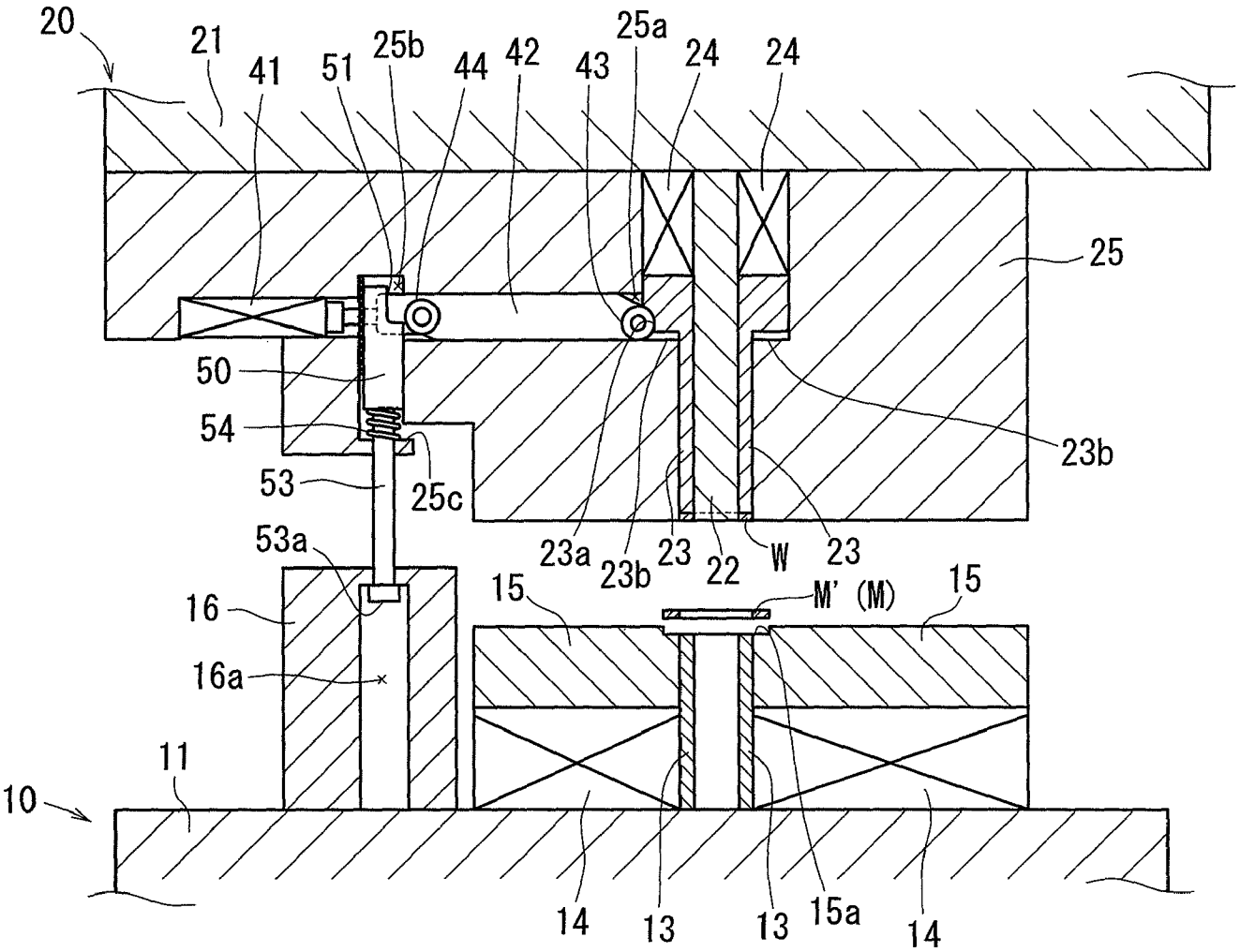
FIG. 6 is a vertical cross-sectional view of the shear punching die assembly, illustrating a condition in which upper and lower die units are further opened from the condition shown in FIG. 4.

When the upper die unit 20 is further moved upwardly, as shown in FIG. 6, the ejector locking member 42 moves upwardly relative to the retainer member 50 because the retainer member 50 cannot move upwardly. In other words, the retainer member 50 is moved downwardly along the vertical hollow portion 25*b* of the die 25. At this time, the compression spring 54 is gradually compressed between the retainer member 50 and the spring seat 25*c* of the die 25.

Figure 7:
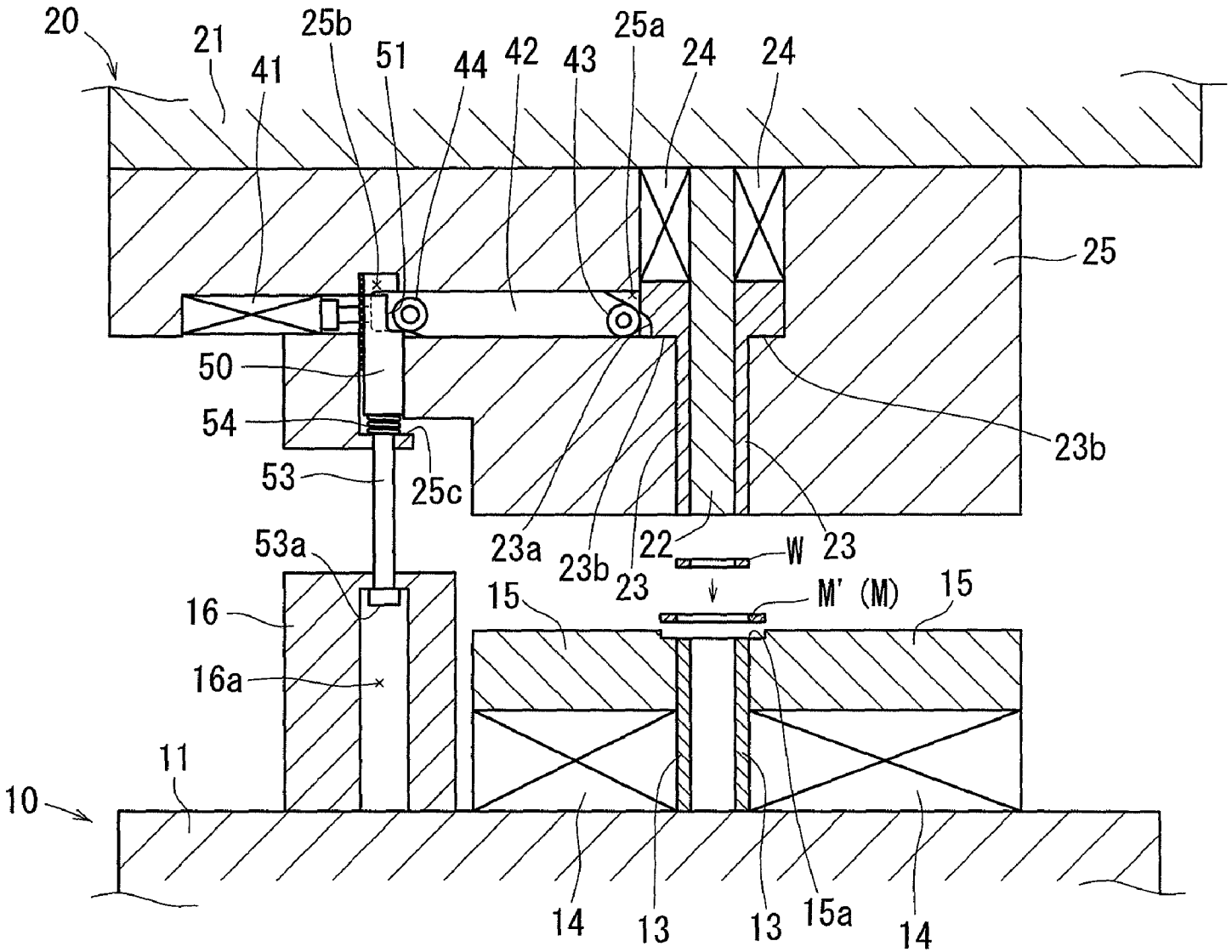
FIG. 7 is a vertical cross-sectional view of the shear punching die assembly, illustrating a condition in which upper and lower die units are fully opened.

When the upper die unit 20 reaches a position shown in FIG. 7, which position correspond to the opened position of the upper die unit 20 shown in FIG. 1, (i.e., when the die opening operation is completed), the retainer member 50 is shifted to a lowermost position in the vertical hollow portion 25*b*, so that the rear rollers 44 of the ejector locking member 42 are aligned with the recess 51 of the retainer member 50. As a result, the ejector 23 is moved downwardly by the spring force of the compression spring 24, so as to move the ejector locking member 42 leftwardly because the spring force of the compression spring 24 is greater than the spring force of the compression spring 41. Therefore, the front roller 43 is disengaged from the notch 23*a* of the ejector 23 and at the same time, the rear rollers 44 reengage the recess 51 of the retainer member 50. Further, upon downward movement of the ejector 23, the work W retained between the upper punch 22 and the die 25 is removed or pushed out by the ejector 23 and falls down. The removed work W may preferably be recovered using a known recovering shovel (not shown). Thus, the work removing operation is completed.

Upon completion of the punching operation and the work removing operation, the manufacturing process is repeated in the same manner as described above while the sheet material M is successively conveyed between the upper and lower die units 10 and 20.

According to the present shear punching die assembly, the work W can be rapidly ejected from the upper die unit 20 because a hydraulic removing mechanism is not used. Therefore, it is possible to easily speed up a manufacturing speed of the work W by simply speeding up the punching operation.

Further, according to the present shear punching die assembly, the work W is reliably retained on the upper die unit 20 until the die opening operation is substantially completed. In other words, the work W can be removed from the upper die unit 20 only after the upper and lower die units 10 and 20 are sufficiently opened. As a result, the work W cannot be pushed toward the processed sheet material M' at the start of the die opening operation. Therefore, the work W can be effectively prevented from reengaging the processed material M' during the die opening operation (the work removing operation).

In addition, according to the present shear punching die assembly, the retainer member 50 moves relative to the ejector locking member 42 depending on the die opening operation and the die closing operation, so that the ejector locking member 42 can move toward and away from the ejector 23. As a result, the front roller 43 of the ejector locking member 42 is automatically engaged with and disengaged from the notch 23*a* of the ejector 23 depending on the die opening operation and the die closing operation, so that the ejector 23 can be locked and unlocked (released). Thus, the ejector retaining device and the ejector releasing device can be structurally simplified.

Second Detailed Representative Embodiment

The second detailed representative embodiment will now described with reference to FIGS. 8-12.

Because the second embodiment relates to the first embodiment, with regard to matters that are the same in the first and second embodiments, a detailed description may be omitted.

Similar to the first embodiment, a shear punching die assembly is intended to press or punch a strip-shaped metal sheet material M in order to form a molded material or work W.

Figure 8:
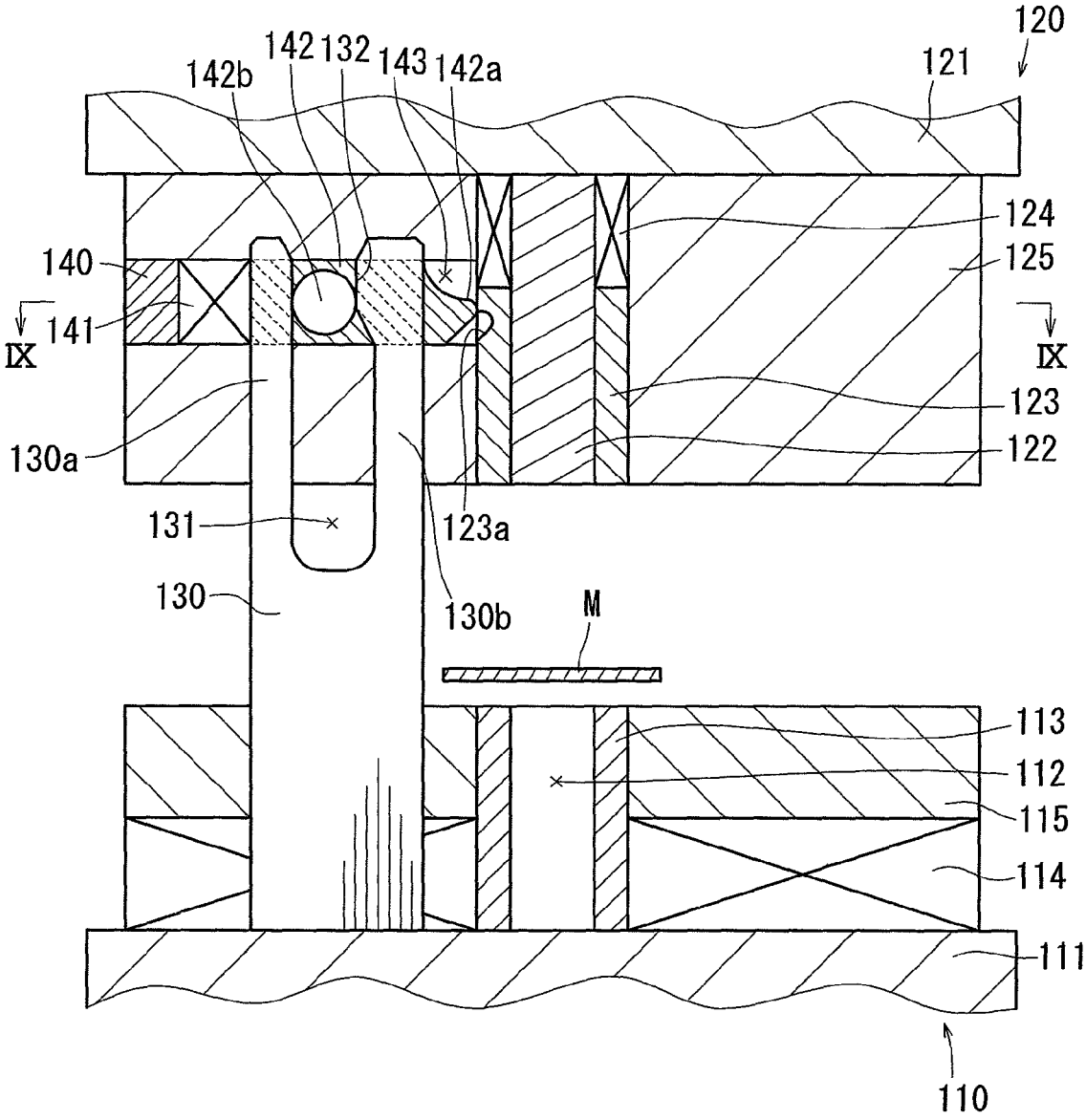
FIG. 8 is a vertical cross-sectional view of a shear punching die assembly according to a second representative embodiment of the present invention, illustrating a condition in which upper and lower die units are opened (an upper dead center of the upper die unit)
Figure 9:
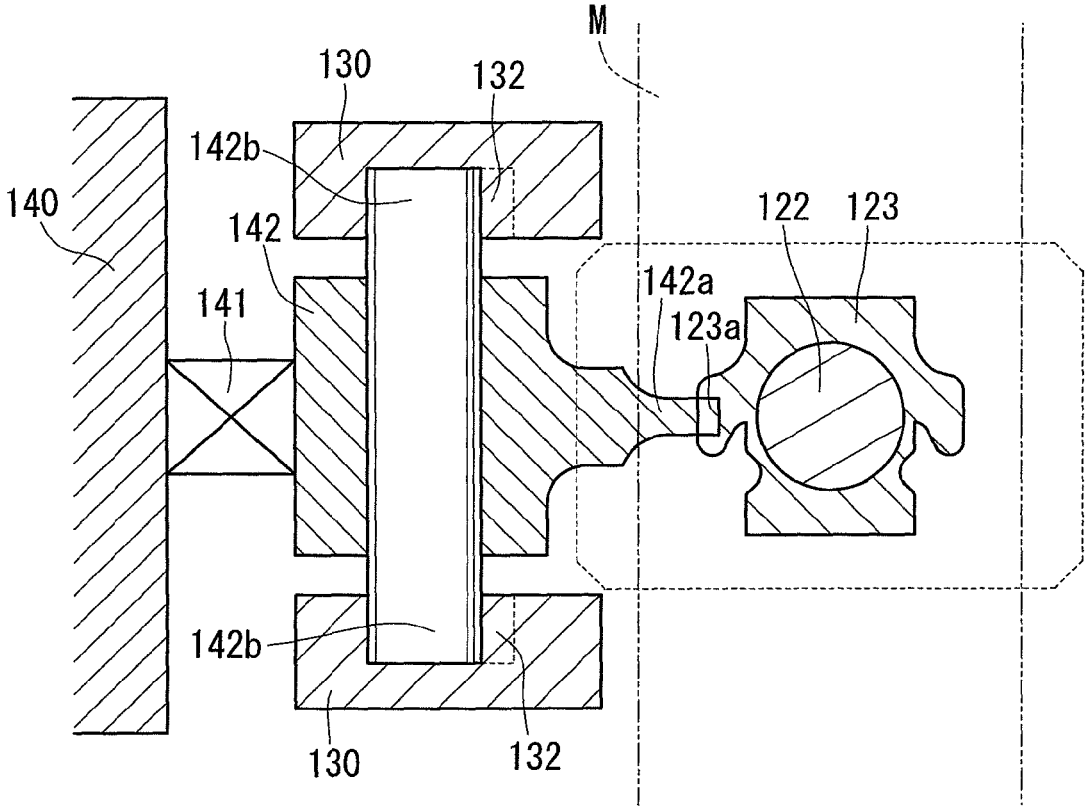
FIG. 9 is a cross-sectional view taken along line IX-IX in FIG. 8, in which a die is omitted.
Figure 10:
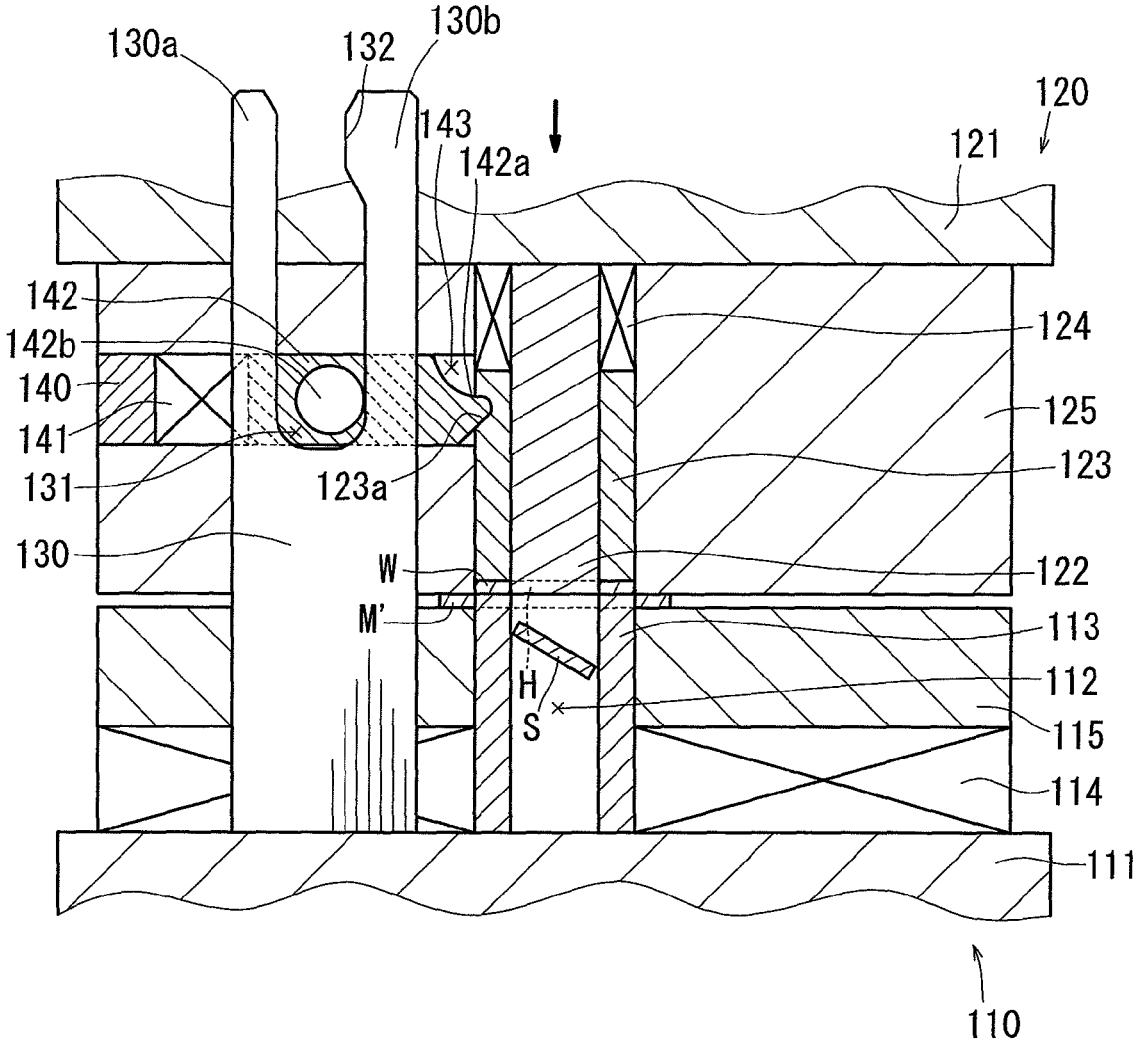
FIG. 10 is a vertical cross-sectional view of the shear punching die assembly, illustrating a condition in which upper and lower die units are closed (a lower dead center of the upper die unit)

As shown in, for example, FIGS. 8 and 9, the shear punching die assembly may include a lower or first die unit (a stationary die unit) 110 that is associated with a lower or first base 111 and an upper or second die unit (a movable die unit) 120 that is associated with an upper or second base 121. Further, the second base 121 is connected to a drive means (not shown), so that the upper die unit 120 can vertically move toward and away from the lower die unit 110.

The lower die unit 110 is essentially composed of a lower pressing member or punch (a main punch) 113 and a stripper 115. The lower punch 113 is fixedly attached to the lower base 111 and having a cross-sectional shape corresponding to the work W to be formed. Also, the lower punch 113 has a vertical punching hole 112 that is formed therein. The stripper 115 is movably disposed around the lower punch 113. In addition, the stripper 115 has a bore having a cross-sectional shape corresponding to the cross-sectional shape of the lower punch 113. That is, the stripper 115 is closely adjacent to the lower punch 113. Also, the stripper 115 is movably attached to the lower base 111 via an elastic member or gas spring 114. Therefore, the stripper 115 is capable of vertically moving along the lower punch 113 while closely contacting the same. As will be appreciated, the gas spring 114 is arranged so as to normally bias the stripper 115 upwardly.

The lower die unit 110 further includes a pair of vertical arms 130. The arms 130 are attached to the lower base 111 so as to extend toward the upper die unit 120. The arms 130 are positioned along a feeding direction of the sheet material M so as to be spaced away from each other (FIG. 9). Also, the arms 130 may preferably be positioned so as to face each other across the stripper 115. As shown in FIG. 8, each of the arms 130 has a pair of opposed upper extensions 130*a* and 130*b*, so that an upwardly opened vertical guide slot 131 is formed therebetween. That is, each of the arms 130 has an upper U-shaped portion. The upper extension 130*b* closer to the sheet material M (i.e., positioned on the right side in FIG. 9) has an upper protrusion (a first contacting member) 132. The upper protrusion 132 is protruded inwardly (leftwardly) such that a width of the guide slot 131 may preferably be reduced.

The upper die unit 120 is essentially composed of an upper pressing member or punch (a subsidiary punch) 122, an ejector 123 and a die 125. The upper punch 122 is fixedly attached to the upper base 121 and having a cross-sectional shape corresponding to the punching hole 112 of the lower punch 113. The ejector 123 is movably disposed around the upper punch 122 and is positioned axially opposite to the lower punch 113. Also, the ejector 123 has a cross-sectional shape corresponding to the work W. In other words, the ejector 123 has the same cross-sectional shape as the lower punch 113. The die 125 is fixedly attached to the upper base 121. The die 125 is positioned around the ejector 123 in such a way that the ejector 123 can move along the die 125. Further, the die 125 has a bore having a cross-sectional shape corresponding to an outer profile of the ejector 123. That is, the die 125 is closely adjacent to the ejector 123. In addition, the ejector 123 is movably attached to the upper base 121 via an ejector biasing member or gas spring 124. Therefore, the ejector 123 is capable of vertically moving along the upper punch 122 and the die 125 while closely contacting the same. As will be appreciated, the gas spring 124 is arranged so as to normally bias the die 125 downwardly.

As shown in FIG. 8, an engagement recess or notch 123*a* is formed in an outer circumferential surface of the ejector 123. Conversely, a hollow portion 143 is laterally formed in the die 125, so as to be communicated with the notch 123*a* of the ejector 123. An ejector locking member (a pressing body) 142 is laterally slidably received in the hollow portion 143, so as to move toward and away from the notch 123*a* of the ejector 123. An inner end (a right end in the drawings) of the ejector locking member 142 is formed with an engagement projection 142*a* that is capable of selectively engaging the notch 123*a*. Further, as will be apparent from FIG. 8, the engagement projection 142*a* is arranged so as to be not aligned with the notch 123*a* (i.e., so as to be slightly displaced upwardly from the notch 123*a*) when the ejector 123 is in a normal position. In addition, an outer end (a left end in the drawings) of the ejector locking member 142 is provided with a compression spring (an ejector locking member biasing member) 141 that is positioned in the hollow portion 143 via an attachment 140 attached to the die 125. Also, the ejector locking member 142 has a transverse rod (a second contacting member) 142*b* having opposed ends. The opposed ends of the rod 142*b* are respectively movabley received in the guide slots 131 of the arms 130, so that the rod 142*b* can vertically move along the guide slots 131.

The compression spring 141 of the ejector locking member 142 is arranged so as to normally bias the ejector locking member 142 rightwardly, i.e., toward the notch 123*a* of the ejector 123. Conversely, as shown in FIG. 8, the upper protrusion 132 formed in the upper extension 130*b* of each of the arms 130 of the lower die unit 110 is positioned so as to contact or engage the transverse rod 142*b* of the ejector locking member 142 when the upper die unit 120 is lifted up.

Further, in this embodiment, the ejector locking member 142 and the compression spring 141 will also be referred to as an ejector retaining device that can retain the ejector 123 in a predetermined position (the retracted position). Also, the upper protrusions 132 formed in the arms 130 and the transverse rod 142*b* of the ejector locking member 142 will be referred to as an ejector releasing device that can release the ejector 123 retained in the predetermined position.

Representative methods for manufacturing the work W from the sheet material M using this shear punching die assembly will now be described.

First, as shown in FIG. 8, the drive means is actuated so that the upper die unit 120 is lifted up to an uppermost position or opened position (i.e., the upper and lower die units 110 and 120 are opened to an opened condition). Thereafter, the sheet material M is fed into a space between the upper and lower die units 110 and 120. Subsequently, the drive means is actuated so that the upper die unit 120 is moved downwardly toward the lower die unit 110 (i.e., a die closing operation or punching operation is started). As a result, the sheet material M is clamped between the upper and lower die units 110 and 120 (between the ejector 123 and the lower punch 113 and between the die 125 and the stripper 115). In this condition, when the upper die unit 120 is further moved toward the lower die unit 110 and reaches a closed position shown in FIG. 10 (i.e., when the die closing operation is completed, so that the upper and lower die units 110 and 120 are closed to a closed condition), the upper punch 122 and the die 125 of the upper die unit 120 respectively engage the lower punch 113 of the lower die unit 110, so as to form the work W having a central opening H. At the same time, a waste or processed sheet material M' and a waste piece S are produced. Thus, the punching operation is completed.

At this time, the ejector 123 of the upper die unit 120 is moved upwardly against a spring force of the gas spring 124, so as to be shifted to an upper retracted position. As a result, the work W may preferably be clamped between the ejector 123 and the lower punch 113. Similarly, the stripper 115 of the lower die unit 110 is moved downwardly against a spring force of the gas spring 114, so as to be shifted to a lower retracted position thereof. As a result, the processed sheet material M' may preferably be clamped between the die 125 and the stripper 115. Further, the waste piece S corresponding to the central opening H of the work W falls down into the punching hole 112 of the lower punch 113.

Further, when the upper die unit 120 is moved downwardly toward the lower die unit 110, the transverse rod 142*b* of the ejector locking member 142 is disengaged from the upper protrusions 132 formed in the upper extensions 130*b* of the arms 130 and is moved downwadly within the guide slots 131 while the engagement projection 142*a* of the ejector locking member 142 contacts the outer circumferential surface of the ejector 123. Thereafter, when the upper die unit 120 is further moved downwardly and reaches the closed position shown in FIG. 10 (i.e., when the die closing operation is completed), as described above, the ejector 123 is shifted to the upper retracted position, so that the engagement projection 142*a* is aligned with the notch 123*a* of the ejector 123. As a result, the ejector locking member 142 is moved rightwardly by a spring force of the compression spring 141, so that the engagement projection 142*a* engages the notch 123*a* of the ejector 123, thereby locking the ejector 123. Thus, the ejector 123 is maintained at the upper retracted position.

Figure 11:
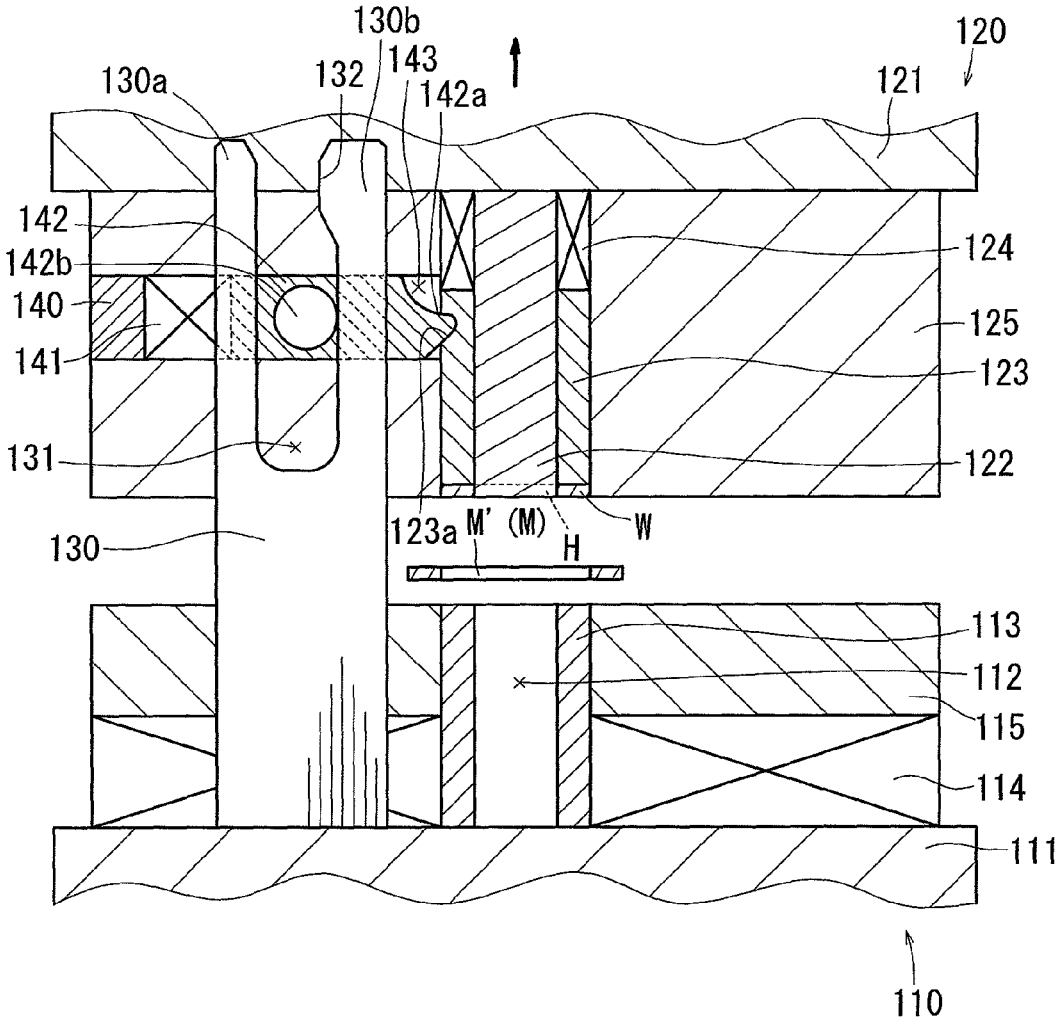
FIG. 11 is a vertical cross-sectional view of the shear punching die assembly, illustrating a condition in which upper and lower die units are half opened from the condition shown in FIG. 10.

After the punching operation is completed, as shown in FIG. 11, the drive means is actuated so that the upper die unit 120 is lifted up toward the opened position. Thus, a die opening operation or work removing operation is started. At this time, the transverse rod 142*b* of the ejector locking member 142 is moved upwardly within the guide slots 131 of the arms 130 while the engagement projection 142*a* still engages the notch 123*a* of the ejector 123. As a result, the upper die unit 120 is lifted up while the ejector 123 is maintained at the upper retracted position. That is, the upper die unit 120 is moved upwardly while the work W is not applied with the spring force of the gas spring 124 via the ejector 123. Therefore, the upper die unit 120 is lifted up while the work W is reliably retained between the upper punch 122 and the die 125 by a frictional force.

Figure 12:
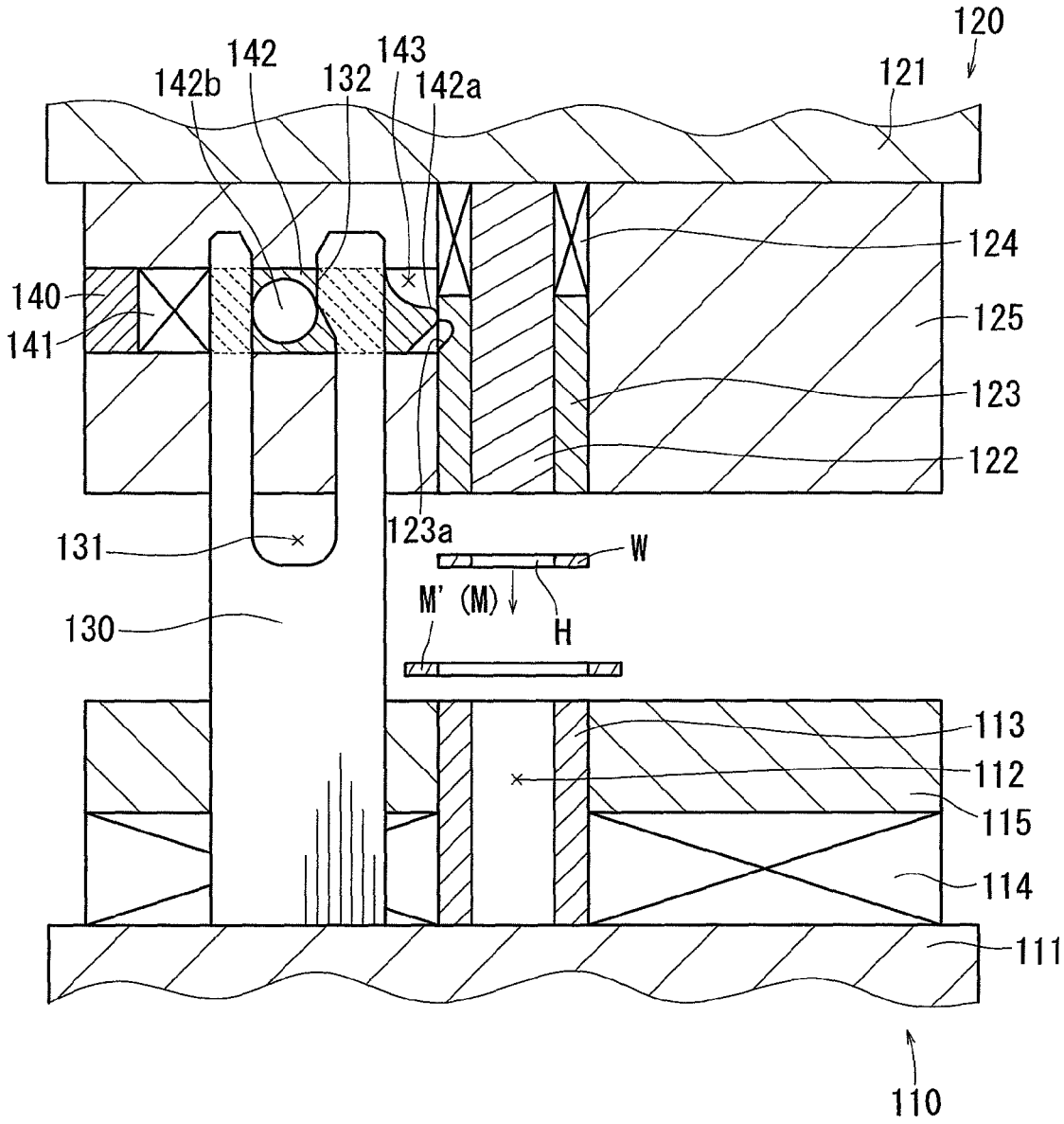
FIG. 12 is a vertical cross-sectional view of the shear punching die assembly, illustrating a condition in which upper and lower die units are fully opened.

Thereafter, when the upper die unit 120 is further moved upwardly and reaches a position shown in FIG. 12, which position substantially corresponds to the opened position shown in FIG. 8, (i.e., when the die opening operation is substantially completed), the transverse rod 142*b* of the ejector locking member 142 reengages the upper protrusions 132 formed in the arms 130. As a result, the ejector locking member 142 is moved leftwardly against the spring force of the compression spring 141, so that the engagement projection 142*a* is disengaged from the notch 123*a* of the ejector 123. Upon disengagement of the engagement projection 142*a* from the notch 123*a*, the ejector 123 is released and pushed back downwardly by the spring force of the gas spring 124. As a result, the work W retained between the upper punch 122 and the die 125 is removed or pushed out by the ejector 123 and falls down. The removed work W may preferably be recovered using a known recovering shovel (not shown).

Upon completion of the punching operation and the work removing operation, similar to the first embodiment, the manufacturing process is repeated in the same manner as described above while the sheet material M is successively conveyed between the upper and lower die units 110 and 120.

According to the present shear punching die assembly, similar to the first embodiment, the work W can be rapidly ejected from the upper die unit 120 because a hydraulic removing mechanism is not used. Therefore, it is possible to easily speed up a manufacturing speed of the work W by simply speeding up the punching operation.

Further, according to the present shear punching die assembly, the work W is reliably retained on the upper die unit 120 until the die opening operation is completed. In other words, the work W can be removed from the upper die unit 120 only after the upper and lower die units 110 and 120 are sufficiently opened. As a result, the work W cannot be pushed toward the processed sheet material M' at the start of the die opening operation. Therefore, the work W can be effectively prevented from reengaging the processed material M' during the die opening operation (the work removing operation).

In addition, according to the present shear punching die assembly, the transverse rod 142*b* of the ejector locking member 142 is engaged with and disengaged from the upper protrusions 132 of formed in the arms 130 depending on the die opening operation and the die closing operation. As a result, the engagement projection 142*a* of the ejector locking member 142 is automatically engaged with and disengaged from the notch 123*a* of the ejector 123, so that the ejector 123 can be locked and unlocked (released). Thus, the ejector retaining device and the ejector releasing device can be structurally simplified.

Naturally, in this embodiment, various changes and modifications may be made to the present invention without departing from the scope of the invention. For example, in this embodiment, although the lower punch (the main punch) 113 and the ejector 123 are respectively disposed on the lower die unit 110 and the upper die unit 120, the lower punch (the main punch) 113 and the ejector 123 are respectively disposed on the upper die unit 120 and the lower die unit 110.

Representative examples of the present invention have been described in detail with reference to the attached drawings. This detailed description is merely intended to teach a person of skill in the art further details for practicing preferred aspects of the present invention and is not intended to limit the scope of the invention. Only the claims define the scope of the claimed invention. Therefore, combinations of features and steps disclosed in the foregoing detail description may not be necessary to practice the invention in the broadest sense, and are instead taught merely to particularly describe detailed representative examples of the invention. Moreover, the various features taught in this specification may be combined in ways that are not specifically enumerated in order to obtain additional useful embodiments of the present invention.

What is claimed is:

1. A shear punching die assembly having first and second die units in which a material is punched to form a work while the material is clamped between the first and second die units, comprising:

a main punch contained in the first die unit and having a cross-sectional shape corresponding to a shape of the work;

an ejector contained in the second die unit and positioned axially opposite to the main punch;

an ejector biasing member normally biasing the ejector toward the main punch;

an ejector retaining device that is capable of acting on the ejector when the first and second die units are in a closed condition, thereby retaining the ejector in a predetermined position; and an ejector releasing device that is capable of acting on the ejector retaining device when the first and second die units are opened over a desired distance, thereby releasing the ejector, wherein the ejector retaining device comprises a pressing body and a retainer member, wherein the retainer member is arranged and constructed to engage the pressing body and press the pressing body toward an outer circumferential surface of the ejector when the first and second die units are in the closed condition, wherein the retainer member is arranged and constructed to be disengaged from the pressing body when the first and second die units are moved to an opened condition, so as to permit the pressing body to move away from the outer circumferential surface of the ejector, wherein the ejector releasing device is composed of the ejector biasing member, wherein the ejector biasing member is arranged and constructed to be capable of moving the ejector when the first and second die units are moved to the opened condition, thereby moving the pressing body away from the outer circumferential surface of the ejector, wherein the ejector is arranged and constructed to vertically move to a desired position against a force of the ejector biasing member when the first and second die units are moved to the closed condition, wherein the pressing body is arranged and constructed to move toward the outer circumferential surface of the ejector when the ejector moves to the desired position, so as to press the outer circumferential surface of the ejector at one end thereof, thereby maintaining the ejector at the desired position, and wherein the retainer member is arranged and constructed to contact the other end of the pressing body so as to prevent the pressing body from moving when the pressing body moves toward the outer circumferential surface of the ejector and presses the outer circumferential surface of the ejector at one end thereof.

2. The shear punching die assembly as defined in claim 1, wherein the ejector comprises an engagement recess that is capable of engaging the pressing body, wherein the retainer member is arranged and constructed to be capable of moving toward and away from the pressing body when the first and second die units are closed and opened, and wherein the pressing body has rollers that are respectively attached to both ends thereof.

3. The shear punching die assembly as defined in claim 1 further comprising a subsidiary punch contained in the second die unit, wherein the subsidiary punch is capable of engaging the main punch when the first and second die units are closed, thereby additionally punching the work.

4. A shear punching die assembly having first and second die units in which a material is punched to form a work while the material is clamped between the first and second die units, comprising:

a main punch contained in the first die unit and having a cross-sectional shape corresponding to a shape of the work;

an ejector contained in the second die unit and positioned axially opposite to the main punch;

an ejector biasing member normally biasing the ejector toward the main punch;

an ejector retaining device that is capable of acting on the ejector when the first and second die units are in a closed condition, thereby retaining the ejector in a predetermined position; and an ejector releasing device that is capable of acting on the ejector retaining device when the first and second die units are opened over a desired distance, thereby releasing the ejector, wherein the ejector retaining device comprises a pressing body and an pressing body biasing member, wherein the pressing body biasing member is arranged and constructed to normally bias the pressing body toward an outer circumferential surface of the ejector, wherein the ejector releasing device comprises a first contacting member formed in an arm that is attached to the first die unit, and a second contacting member formed in the pressing body, and wherein the first contacting member is arranged and constructed to engage the second contacting member when the first and second die units are moved to the opened condition, thereby moving the pressing body away from the outer circumferential surface of the ejector against a biasing force of the pressing body biasing member.

5. The shear punching die assembly as defined in claim 4, wherein the pressing body and the ejector respectively comprise an engagement projection and an engagement recess that are capable of engaging each other, and wherein the first and second contacting members respectively comprises a protrusion formed in the arm and a rod attached to the pressing body.

6. The shear punching die assembly as defined in claim 5, wherein the arm has a guide slot that is arranged and constructed such that the rod can move therealong when the upper and lower die units are relatively moved, and wherein the protrusion is projected into the guide slot such that a width of the guide slot can be reduced.

7. A shear punching die assembly having upper and lower die units in which a material is punched to form a work while the material is clamped between the upper and lower die units, comprising:

a main punch contained in the lower die unit;

a stripper contained in the lower die unit, the stripper being arranged and constructed to be movable relative to the main punch while it is biased upwardly;

a die contained in the upper die unit and positioned axially opposite to the stripper, an ejector contained in the upper die unit and positioned axially opposite to the main punch, the ejector having an engagement recess formed in an outer circumferential surface thereof and being arranged and constructed to be movable relative to the die while it is biased downwardly;

a pressing body arranged and constructed to move toward and away from the engagement recess of the ejector;

a retainer member arranged and constructed to engage the pressing body and press the pressing body toward the ejector when the pressing body engages the engagement recess of the ejector, wherein when the upper and lower die units are closed so that the material is punched to form the work, the formed work is pushed into the die so that the ejector is moved upwardly to a predetermined position by the work and as a result, the engagement recess of the ejector is vertically aligned with the pressing body so that the pressing body engages the engagement recess of the ejector and simultaneously, the retainer member engages the pressing body and presses the pressing body toward the ejector, so that the ejector can be retained in the predetermined position while the work is retained in the die by a frictional force, and wherein when the upper and lower die units are opened over a desired distance, the retainer member is disengaged from the pressing body and as a result, the ejector is moved downwardly while removing the work from the die, so that the pressing body is disengaged from the engagement recess of the ejector.

8. A shear punching die assembly having upper and lower die units in which a material is punched to form a work while the material is clamped between the upper and lower die units, comprising:

a main punch contained in the lower die unit;

a stripper contained in the lower die unit and positioned around the main punch;

an ejector contained in the upper die unit and positioned axially opposite to the main punch, the ejector having an engagement recess;

a die contained in the upper die unit and positioned around the ejector;

a pair of arms contained in the lower die unit and extending toward the upper die unit therefrom, wherein each of the arms is positioned along a feeding direction of the material and is formed to substantially a U-shape so as to have a guide slot therein, and wherein each of the arms has a protrusion that is formed in a side facing to the material and is projected into the guide slot such that a width of the guide slot can be reduced; and a pressing body contained in the upper die unit and laterally biased toward the engagement recess of the ejector, wherein the pressing body has an engagement projection that is capable of engaging the engagement recess of the ejector and a rod that is capable of moving along the guide slot of each of the arms, wherein when the upper and lower die units are closed, the ejector is moved upwardly to a predetermined position so that the engagement recess of the ejector is vertically aligned with the engagement projection of the pressing body and as a result, the engagement projection of the pressing body engages the engagement recess of the ejector, so that the ejector can be retained in the predetermined position, and wherein when the upper and lower die units are opened, the rod of the pressing body engages the protrusion of each of the arms so that the pressing body is laterally reversely moved and as a result, the engagement projection of the pressing body is disengaged from the engagement recess of the ejector, so that the ejector can be released.

9. The shear punching die assembly as defined in claim 8 further comprising a subsidiary punch contained in the upper die unit, wherein the subsidiary punch is capable of engaging the main punch when the upper and lower die units are closed, thereby additionally punching the work.

* * * * *